US006464038B1

(12) United States Patent
Park

(10) Patent No.: US 6,464,038 B1
(45) Date of Patent: Oct. 15, 2002

(54) FOOTREST FOR ROCK CLIMBING

(75) Inventor: Sang Hwan Park, Ga-302 Wooanam Villa, 287 Toegewon-ri, Toegewon-myon, Namyangju, Kyongkido (KR), 472-821

(73) Assignees: Sang Hwan Park, Kyongkido (KR); Chang Ho Kim, Kyongkido (KR); Hyup Jeon, Kyongkido (KR)

( * ) Notice: Subject to any disclaimer, the term of this patent is extended or adjusted under 35 U.S.C. 154(b) by 0 days.

(21) Appl. No.: 10/076,413

(22) Filed: Feb. 19, 2002

(30) Foreign Application Priority Data

Aug. 20, 2001 (KR) ..... 2001-49938

(51) Int. Cl.[7] ..... E06C 9/00
(52) U.S. Cl. ..... 182/92; 182/91; 182/3
(58) Field of Search ..... 182/3, 90–92, 182/150, 194, 196, 152

(56) References Cited

U.S. PATENT DOCUMENTS 271,802 A * 2/1883 Craigie
382,550 A * 5/1888 Parker
2,226,489 A * 12/1940 Doherty
4,258,828 A * 3/1981 Evan ..... 182/95
5,704,447 A * 1/1998 Doyle ..... 182/90

* cited by examiner

*Primary Examiner*—Alvin C Chin Shue
(74) *Attorney, Agent, or Firm*—Lowe Hauptman Gilman & Berner, LLP

(57) ABSTRACT

A footrest for rock climbing includes a rest member for supporting the foot of a climber, a pair of support bars collapsibly connected to opposite ends of the rest member, respectively, and a hook arrangement for fixing free ends of the support bars with respect to each other. The hook arrangement serves to maintain the support bars and the rest member in the form of a substantially triangular shape and connects the fixed free ends of the support bars to a fixed member on a rock. The hook arrangement includes hanging holes respectively formed on the free ends of the support bars, and a ring-hook inserted through the hanging holes aligned together. The ring-hook is connected to the fixed member on the rock.

4 Claims, 7 Drawing Sheets

FOOTREST FOR ROCK CLIMBING

BACKGROUND OF THE INVENTION

1. Field of the Invention

The present invention relates to a footrest for rock climbing, and more particularly to a footrest for rock climbing, which allows the climber to tread thereon, thereby comfortably ascending a rock during overhang climbing under the condition in which the climber treads on the footrest.

2. Description of the Related Art

Rock climbing as sports requiring great strength and skill is classified into slab climbing, face climbing, crack climbing, overhang climbing, etc, according to rocks to be climbed. Slab climbing is a sport, in which the climber ascends slabs with a gradient of about 30°–70°. In face climbing, the climber climbs rock walls with a gradient of about 70°–90°. Crack climbing is a sport, in which the climber climbs using cracks of rock walls. Overhang climbing is a sport, in which the climber can climb near-vertical rock walls, namely, rock walls with a gradient of over 90°. Such rock climbing has been recently highlighted in that the climber can feel utmost thrill and have adventures, while building a strong body and spirit.

However, as the climber ascends steep rock walls during rock climbing, many accidents may occur by the shortage of climbing holds to be grabbed by hands, and climbing stands to be stepped on by the foot of the climber for climbing. Particularly, beginners relatively lack the climbing skills such as handhold skills using hands and footwalk skills using feet. Accordingly, beginners suffer more difficulties in the circumstance where there are no climbing holds and stands. More particularly, in the case of overhang climbing in which the climber ascends a rock with gradient of over 90°, beginners as well as experienced climbers suffer more difficulties because there are relatively few holds and stands in overhang climbing as compared with face climbing and slab climbing on the rock with a gradient of 90° and below, and the crack climbing on the rock walls having cracks.

SUMMARY OF THE INVENTION

Therefore, the present invention has been made in view of the above problems, and it is an object of the present invention to provide a footrest for rock climbing, particularly overhang climbing, in the circumstance where there are few climbing holds to be grabbed by hands and climbing stands to be stepped on by the foot, which allows the climber to tread thereon, thereby a user comfortably ascending a rock during overhang climbing under the condition in which the climber treads on the footrest.

It is another object of the present invention to provide a footrest for rock climbing, which allows the climber to tread thereon, while the climber comfortably ascending a rock during rock climbing, thereby enabling even beginners to readily climb steep rock walls.

It is a yet another object of the present invention to provide a footrest for rock climbing, which is manufactured to be stepped on by the climber, thereby allowing the climber to comfortably and securely take a rest under the condition in which the climber is supported by the footrest.

In accordance with the present invention, the above and other objects can be accomplished by the footrest for rock climbing comprising: a rest member for supporting the foot of a climber; a pair of support bars collapsibly connected to opposite ends of the rest member, respectively; and hooking means for fixing free ends of the support bars with respect to each other, while maintaining the support bars and the rest member in the form of a substantially triangular shape, the hooking means connecting the fixed free ends of the support bars to a fixed member on a rock.

Preferably, hooking means may comprises hanging holes respectively formed on the free ends of the support bars, and a ring-hook inserted through the hanging holes aligned together, the ring-hook being connected to the fixed member on the rock.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
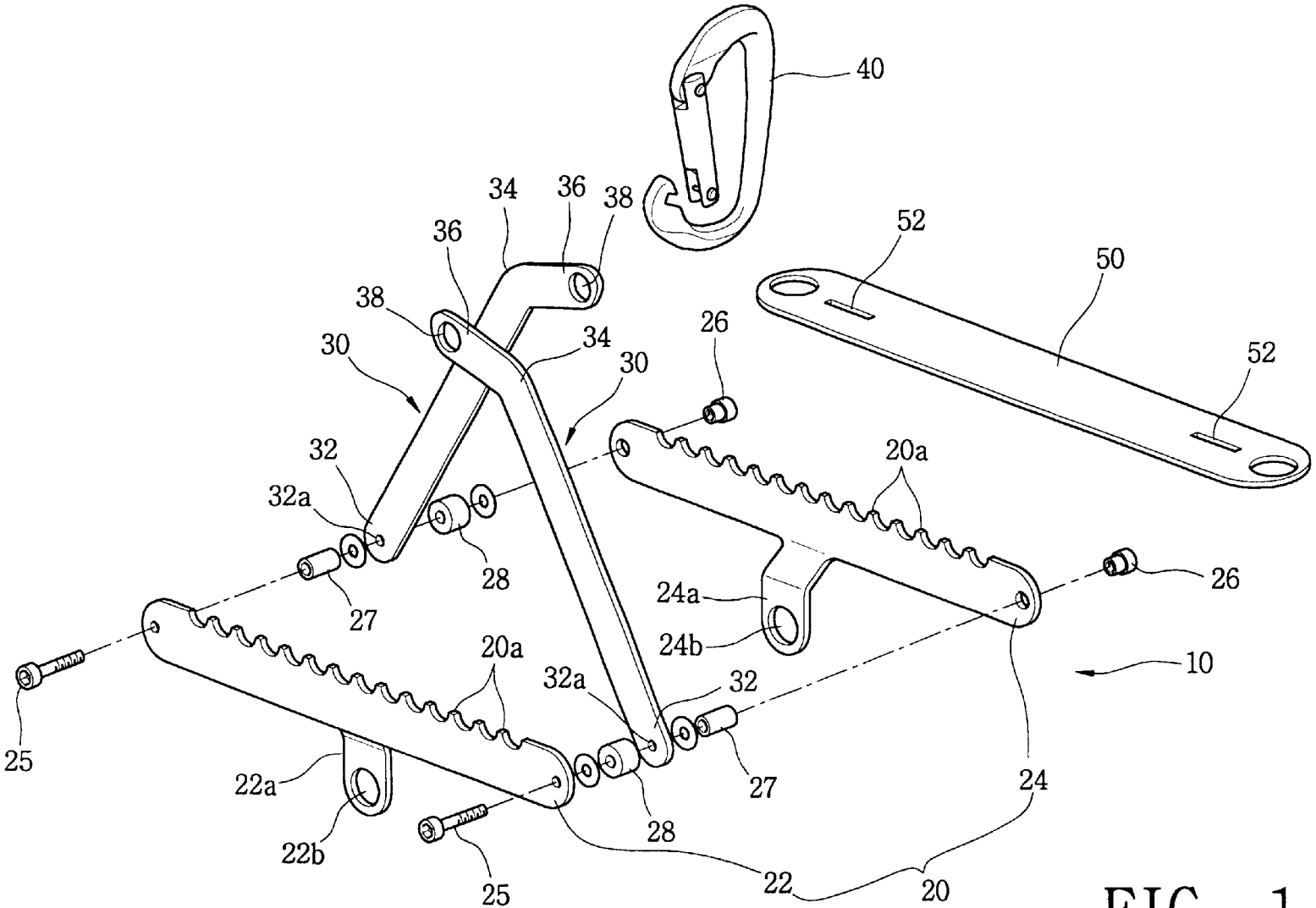
FIG. 1 is a perspective view showing the construction of an exploded footrest for rock climbing in accordance with the present invention.
Figure 2:
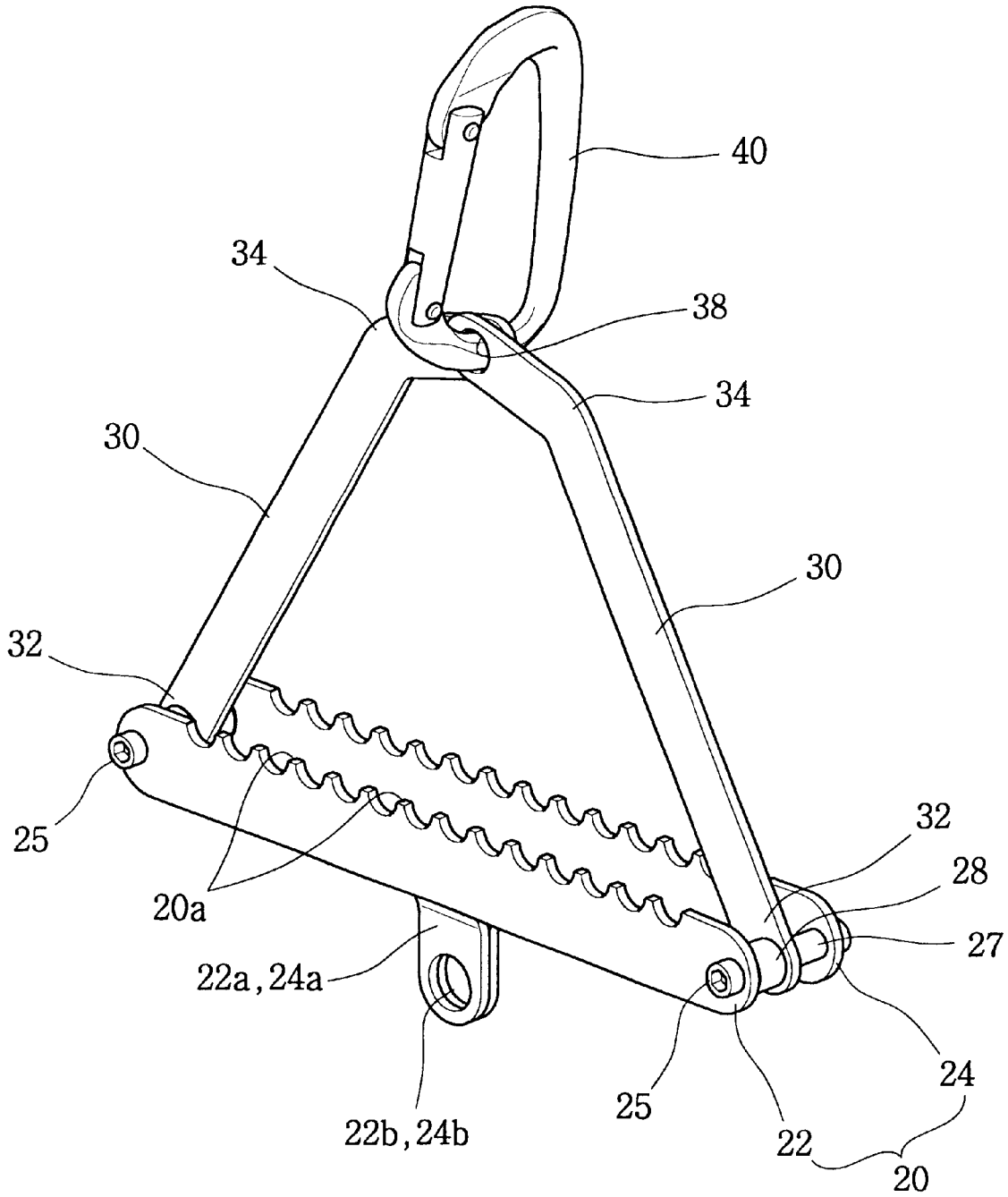
FIG. 2 is a perspective view showing the assembled footrest for rock climbing shown in FIG. 1.

Referring to FIGS. 1 and 2, there is shown a perspective view of a footrest for rock climbing in accordance with the present invention.

As shown in FIG. 1, the footrest 10 for rock climbing according to the present invention includes a rest member 20. The rest member 20 is adapted to support the foot of the climber, and includes first and second rest bodies 22 and 24 which are spaced apart from each other while extending in parallel. Each of the first and second rest bodies 22 and 24 is a plate having a desired thickness. The first and second rest bodies 22 and 24 are integrally connected with each other by support bolts 25 and nuts 26 inserted through both ends of the first and second rest bodies 22 and 24, respectively, in the state that the first and second rest bodies 22 and 24 are parallel each other. First and second spacers 27 and 28 are fitted around each support bolt 25 so that they are arranged between the first and second rest bodies 22 and 24. The first and second spacers 27 and 28 serve to maintain a uniform distance between the first and second rest bodies 22 and 24. The first and second spacers 27 and 28 have different lengths, respectively.

Preferably, the rest member 20 is made of a material exhibiting superior strength and light weight, such as duralumin alloys, in order to maintain a desired strength for sufficiently bearing the load of the climber and to facilitate carriage of the footrest. A plurality of anti-slip protrusions 20*a* are formed along the upper surface of each rest body 22 or 24 of the rest member 20, in order to prevent the foot of the climber from slipping. Each rest body 22 or 24 has a protrusion portion 22*a* or 24*a* extending vertically down from the central portion of the rest body 22 or 24. The protrusion portions 22*a* and 24*a* are bent toward each other, so that they come into contact with each other. The protrusion portions 22*a* and 24*a* will be described hereinafter in detail.

The footrest according to the present invention also includes a pair of support bars 30 collapsibly connected to respective ends of the rest member 20. Each support bar 30 is provided at one end thereof with a fixed end pivotably connected to the rest member 20, and at the other end thereof with a free end pivoting about the fixed end. In the procedure of assembling the rest bodies 22 and 24 of the rest member 20, each support bolt 25 is extended through a hinge hole 32*a* formed at the fixed end of the associated support bar 30, so that the support bar 30 is pivotably assembled to the rest member 20. In the procedure of assembling the support bars 30 with the support bolts 25, each support bar 30 is arranged between the associated first and second spacers 27 and 28.

Figure 3:
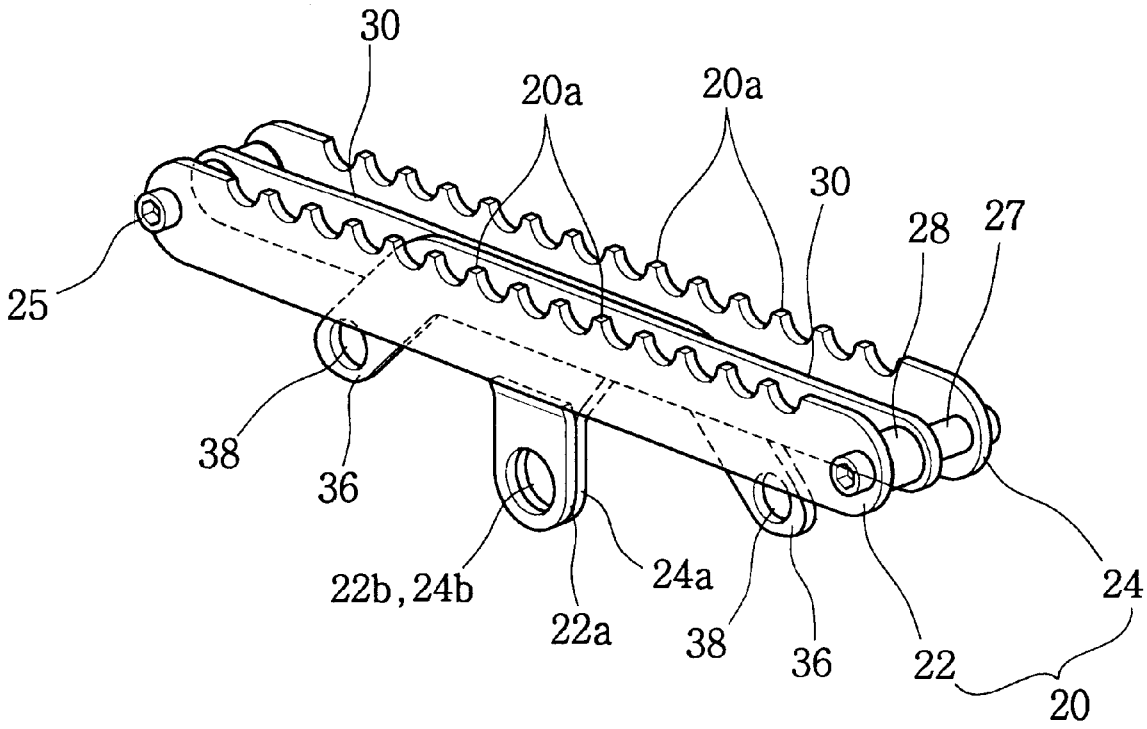
FIG. 3 is a perspective view showing an operational condition of support bars of the footrest for rock climbing according to the present invention, the support bars being main parts of the footrest.

The arrangement order of the first and second spacer 27 and 28 at opposite sides of one support bar 30 should be opposite that at opposite sides of the other support bar 30. For example, where the first spacer 27 having a longer length is arranged at one side of one support bar 30, the second spacer 28 having a shorter length should be arranged at the same side of the other support bar 30. On the other hand, where the shorter second spacer 28 is arranged at one side of one support bar 30, the longer first spacer 27 should be arranged at the same side of the other support bar 30. In accordance with such an arrangement, the support bars 30 can be arranged on different vertical planes so that they are collapsible while crossing each other. Concretely speaking, the support bars 30 having the above described constructions are collapsibly connected to respective ends of the rest member 20, while pivoting about the support bolts 25. Particularly, if the support bars 30 are unfolded from the rest member 20 as shown in FIG. 2, they form a substantially triangular shape with the rest member 20. On the other hand, when the support bars 30 are folded into the rest member 20 as shown in FIG. 3, they are overlapped with the first and second rest bodies 22 and 24, thereby forming a linear shape together with the rest member 20. When the support bars 30 are folded in the rest member 20, they come into contact with respective protrusion portions 22*a* and 24*a* formed at the first and second rest bodies 22 and 24, so that their further rotation is prevented. Preferably, each support bar 30 is made of a material exhibiting superior strength and light weight, such as duralumin alloys like the rest member 20.

Figure 4:
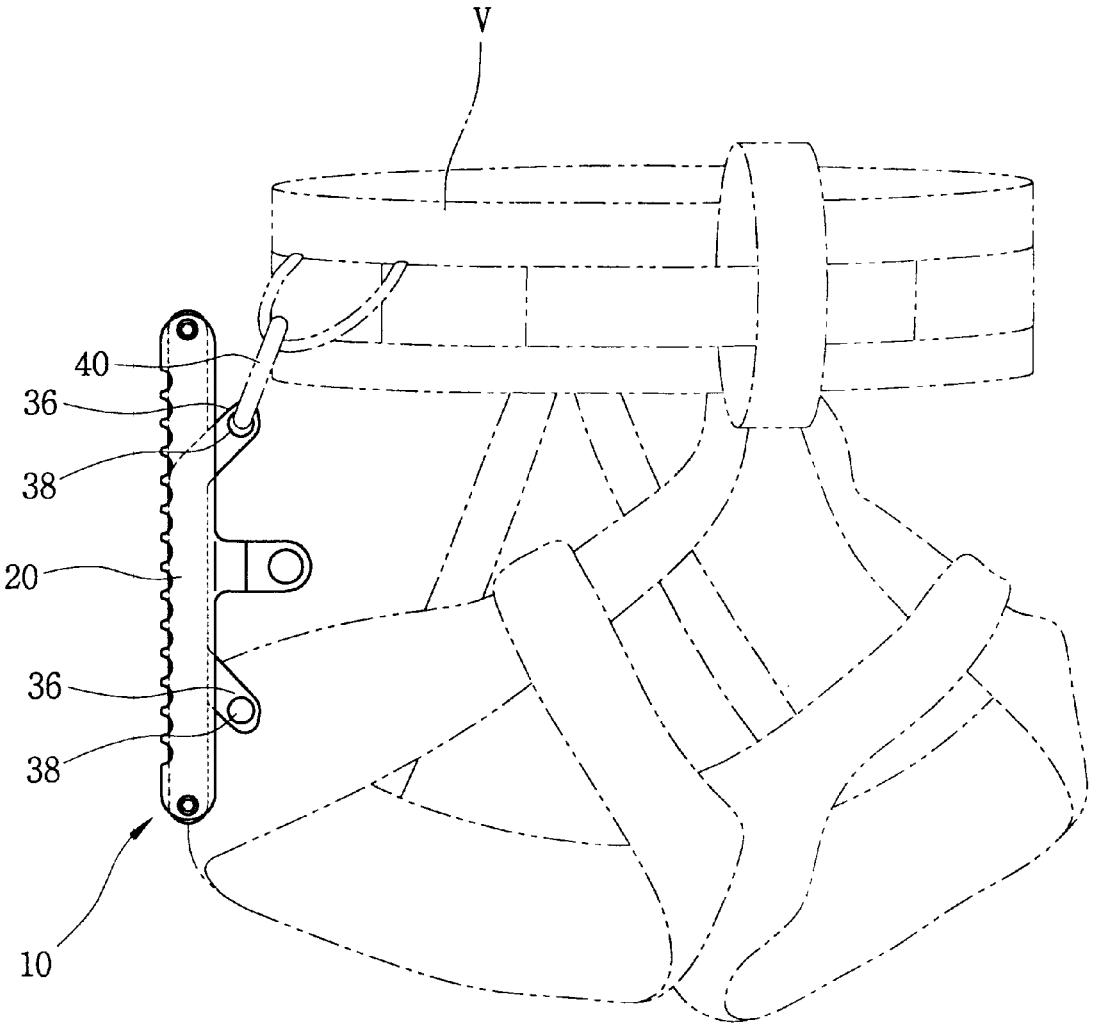
FIG. 4 is a perspective view showing the footrest for rock climbing according to another embodiment of the present invention, the footrest being assembled with an auxiliary rest.

As shown in FIG. 1, each support bar 30 according to the present invention has an extended portion 36 extending inwardly from the fixed end 34, and having a hanging hole 38. As shown in FIG. 4, when each support bar 30 is folded in the rest member 20, its extended portion 36 is protruded beyond one surface of the rest member 20. Such a construction enables the extended portion 36 to be connected to a safety belt V worn by the climber, thereby allowing the climber to carry the footrest.

Return to FIG. 1, the footrest 10 of the present invention further includes hooking means adapted to the fix free ends of the support bars with respect to each other, while connecting those free ends to a fixed member on the rock, such as a haken, camming, bolt, chalk, nut, friend, etc. Such hooking means may comprise by a ring-hook 40 so called a "carabiner". The hooking means 40 is inserted through the hanging holes 38 of the support bars 30 aligned together, thereby fixing free ends 34 of the support bars 30 with respect to each other. Now, the ring-hook 40 can be directly connected to the fixed member on the rock, or can be indirectly hung to the fixed member on the rock, for example, through a quick draw, etc, which connects two carabiners. Accordingly, by the ring-hook 40, the rest member 20 and support bars 30 are securely hung at the fixed member such that they form a triangular shape.

As shown in FIG. 1, the footrest 10 of the present invention further includes an auxiliary rest 50. The auxiliary rest 50 is mounted on the upper surface of the rest member 20 when in use. The auxiliary rest 50 is a plate having a larger width and area than the rest member 20, and the auxiliary rest 50 has mounting slots 52 at both ends thereof in order to allow the support bars to extend therethrough. More specifically, as shown in FIG. 4, the auxiliary rest 50 is seated on the rest member 20 in the state in which the support bars 30 extend through the mounting slots 52, respectively. Thus, the auxiliary rest 50 is integrally connected with the rest member 50. Since the auxiliary rest 50 supports the foot of the climber with a larger width than that of the rest member, it can allow the climber to take a rest more comfortably in a stable condition. Further, the auxiliary rest 50 may be selectively used in accordance with a desire of the climber.

Figure 5:
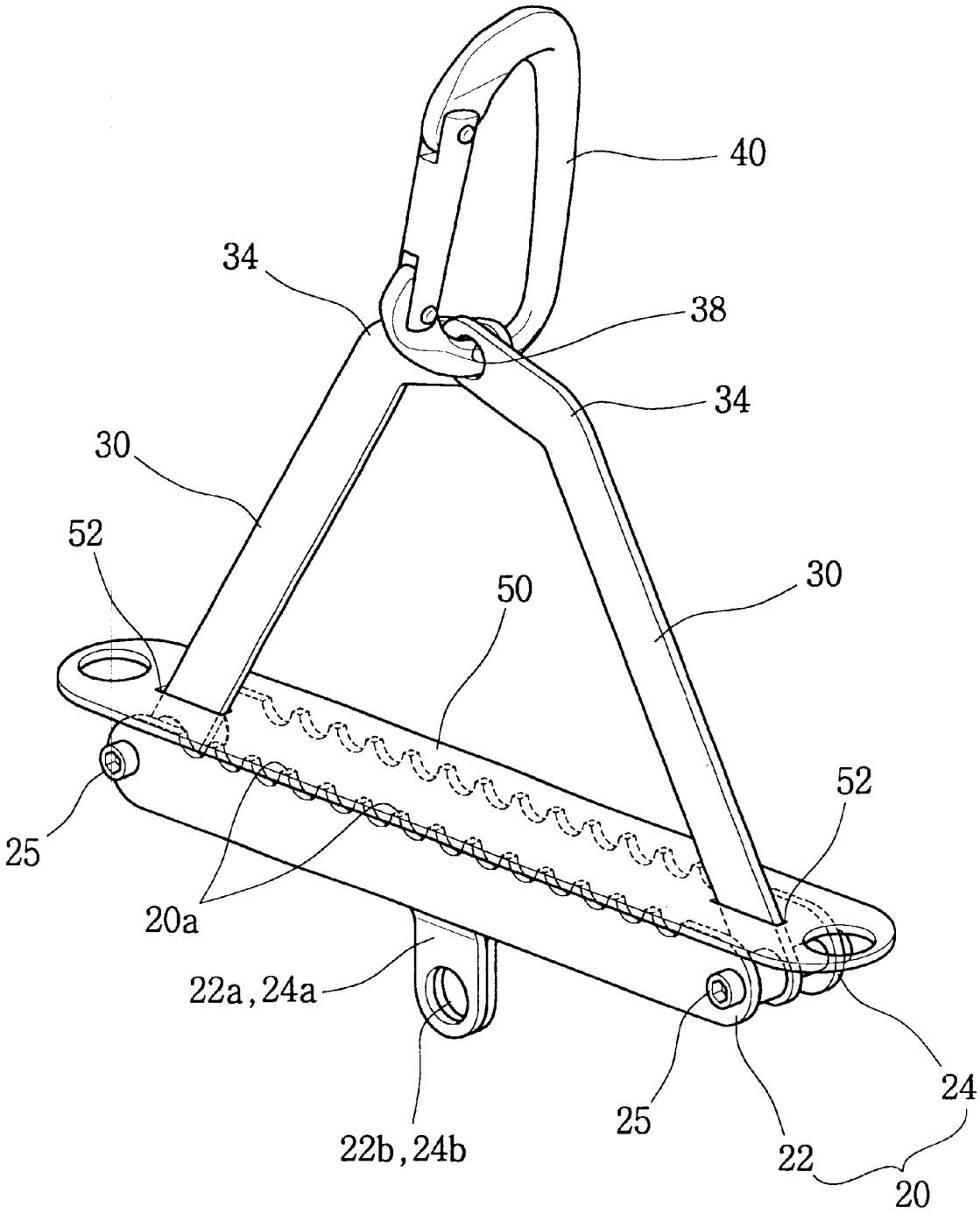
FIGS. 5 to 7 are views showing a footrest for rock climbing according to the example of the present invention.
Figure 6:
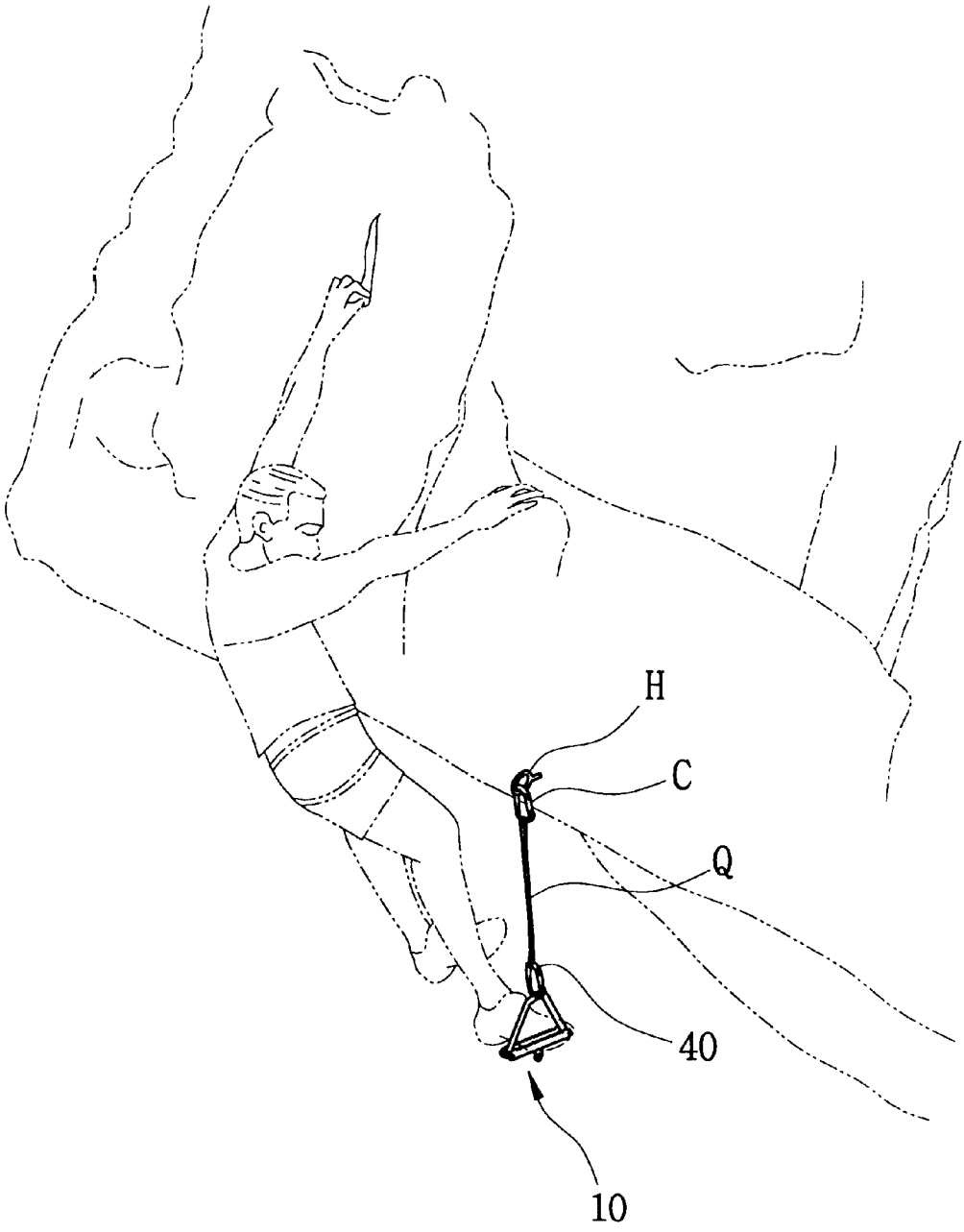

Examples illustrating usages of the footrest having the above described construction according to the present invention will now be described referring to the FIGS. 2, 5 and 6, respectively. Firstly, where the footrest according to the present invention is to be used for rock climbing, particularly overhang climbing, the rest member 20 and support bars 30 of the footrest are first detached from a safety belt V worn by the climber as shown in FIG. 5. As shown in FIG. 2, the support bars 30 folded in the rest member 20 are then unfolded, so as to align the hanging holes 38 with each other. The ring-hook 40 is inserted through the aligned hanging holes 38, thereby locking free ends 34 of the support bars 30. Accordingly, the support bars 30 maintain a substantially triangular shape. Under such a condition, as shown in FIG. 6, the climber connects the ring-hook 40 with the fixed member on the rock such as a haken, camming, bolt, chalk, nut, friend, etc. After the climber has finally confirmed to the security of the footrest, the climber will step on the rest member of the footrest in order to ascend toward a next fixed member, or will take a rest upon stepping on the footrest. Of course, the ring-hook 40 of the present invention can be engaged with quick draws Q and carabiners C when in use, as shown in FIG. 6 according to the circumstances.

Figure 7:
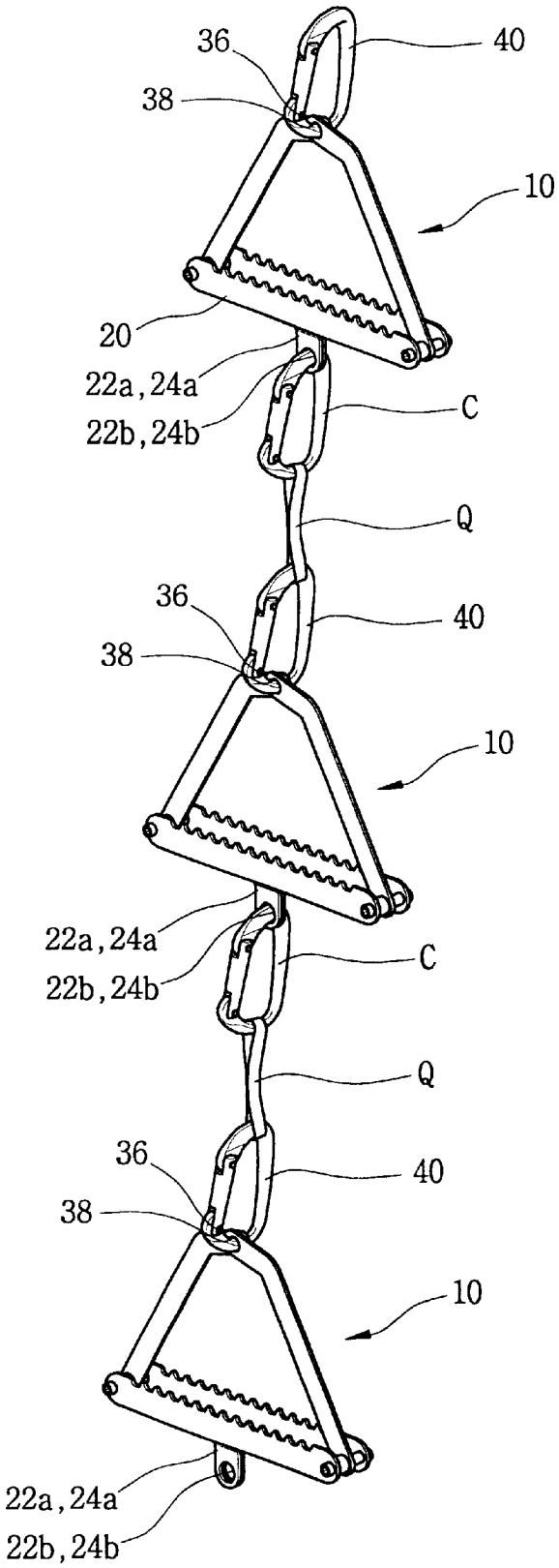

FIG. 7 shows another example illustrating usage of the footrest according to the present invention. In this example, several footrests are connected to one another in series so that they can be used as a ladder, as shown in FIG. 7. A carabiner C is inserted through the connecting holes 22*b* and 24*b* of protrusion portions 22*a* and 24*a* protruded from the rest bodies 22 and 24 in one footrest. The carabiner C is then connected with another carabiner inserted through hanging holes 38 of another footrest by a quick draw Q. A plurality of footrests are connected in series using carabiners C and quick draws Q as described above. The footrests can form a ladder of a long length. During rock climbing, the footrests connected in the form of a ladder allow the climber to rapidly ascend or descend the rock with a steep gradient, or aid to quickly rescue incapacitated climbers.

As described above, the footrest according to the present invention includes a rest member 20 for supporting the foot of the climber, a pair of support bars 30 connected to respective ends of the rest member 20 while forming a substantially triangular shape with the rest member 20, and hooking means for connecting the support bars with a fixed member on the rock. Accordingly, even though there are few climbing holds graspable with hands and climbing stands stepped on by the foot of the climber for overhang climbing, the climber can step on the footrest, thereby readily ascending the rock under the condition in which the climber treads on the footrest. Particularly, beginners having little experience can readily ascend the rock in such a condition, and can securely and comfortably take a rest upon stepping on the footrest at the same time. Further, the footrests connected in series as occasion demands can be used as the ladder.

In the above example of the present invention, the footrest 10 is described as being used on natural rocks, but it is understood that the present invention is not limited thereto, and can be used, for example, on artificial rocks.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

As apparent from the above description, the present invention provides a footrest for rock climbing including a footrest 20 for supporting the foot of the climber, a pair of support bars 30 connected to respective ends of the rest member 20 while forming a substantially triangular shape with the rest member 20, and hooking means for connecting the support bars with a fixed member on the rock. Accordingly, even though there are few climbing holds graspable with hands and climbing stands stepped on by the foot of the climber during overhang climbing, the climber can step on the footrest, thereby readily ascending the rock under the condition in which the climber treads on the footrest. Particularly, beginners having little experience can readily ascend the rock in such a condition, and can securely and comfortably take a rest upon stepping on the footrest at the same time. Further, the footrests connected in series as occasion demands can be used as the ladder. During rock climbing, the footrests connected as such a ladder shape aid to quickly rescue incapacitated climbers.

What is claimed is:

1. A footrest for rock climbing comprising:

a rest member for supporting the foot of a climber;

a pair of support bars collapsibly connected to opposite ends of the rest member, respectively; and hooking means for fixing free ends of the support bars with respect to each other, while maintaining the support bars and the rest member in the form of a substantially triangular shape, the hooking means connecting the fixed free ends of the support bars to a fixed member on a rock.

2. The footrest as set forth in claim 1, wherein the hooking means comprises hanging holes respectively formed on the free ends of the support bars, and a ring-hook inserted through the hanging holes aligned together, the ring-hook being connected to the fixed member on the rock.

3. The apparatus as set forth in claim 1, further comprising an auxiliary rest capable of fixedly being mounted on an upper surface of the rest member, the auxiliary rest having a larger width and longer length than the rest member.

4. The apparatus as set forth in claim 1, wherein the rest member is provided with connecting holes for allowing the hooking means of another footrest to be connected therewith.

* * * * *